United States Patent [19]

Hadden et al.

[11] 4,005,921

[45] Feb. 1, 1977

[54] TRANSMISSION CABLE CONNECTOR AND TERMINATION METHOD

[75] Inventors: Edward Leal Hadden, Mechanicsburg; Robert Franklin Evans, New Cumberland, both of Pa.

[73] Assignee: E. I. Du Pont de Nemours and Company, Wilmington, Del.

[22] Filed: Feb. 23, 1976

[21] Appl. No.: 660,180

[52] U.S. Cl. ..... 339/14 R; 339/22 B; 339/103 R

[51] Int. Cl.[2] ..... H01R 3/06

[58] Field of Search ..... 339/14 R, 17 F, 17 L, 339/22 B, 95 R, 96, 97 R, 98, 99, 100, 103 R

[56] References Cited

UNITED STATES PATENTS

| | | | |
|---|---|---|---|
| 3,582,864 | 6/1971 | Sullivan | 339/22 B X |
| 3,634,806 | 1/1972 | Fergusson | 339/14 R |
| 3,731,254 | 5/1973 | Key | 339/17 CF |
| 3,907,396 | 9/1975 | Huber | 339/103 R |
| 3,912,354 | 10/1975 | Campbell et al. | 339/99 R |
| 3,963,319 | 6/1976 | Schumacher et al. | 33/99 R X |

*Primary Examiner*—Roy Lake
*Assistant Examiner*—DeWalden W. Jones

[57] ABSTRACT

An electrical connector for a flat multi-conductor transmission cable includes a cable terminating face, a parapet having a plurality of V-shaped grooves and a scalloped top extending from the face, a bus strip engageable with the face, and a cover. Also, a method for terminating the cable includes severing an insulated sheath of the cable intermediate its end, sliding the severed insulated end along a length of the conductors to expose the shield and signal conductors, severing the signal conductors, folding the insulated end of the transmission cable back along its length over a bus strip, and engaging the shield conductors with the bus and the signal conductors with electrical terminals on the face of the connector.

13 Claims, 9 Drawing Figures

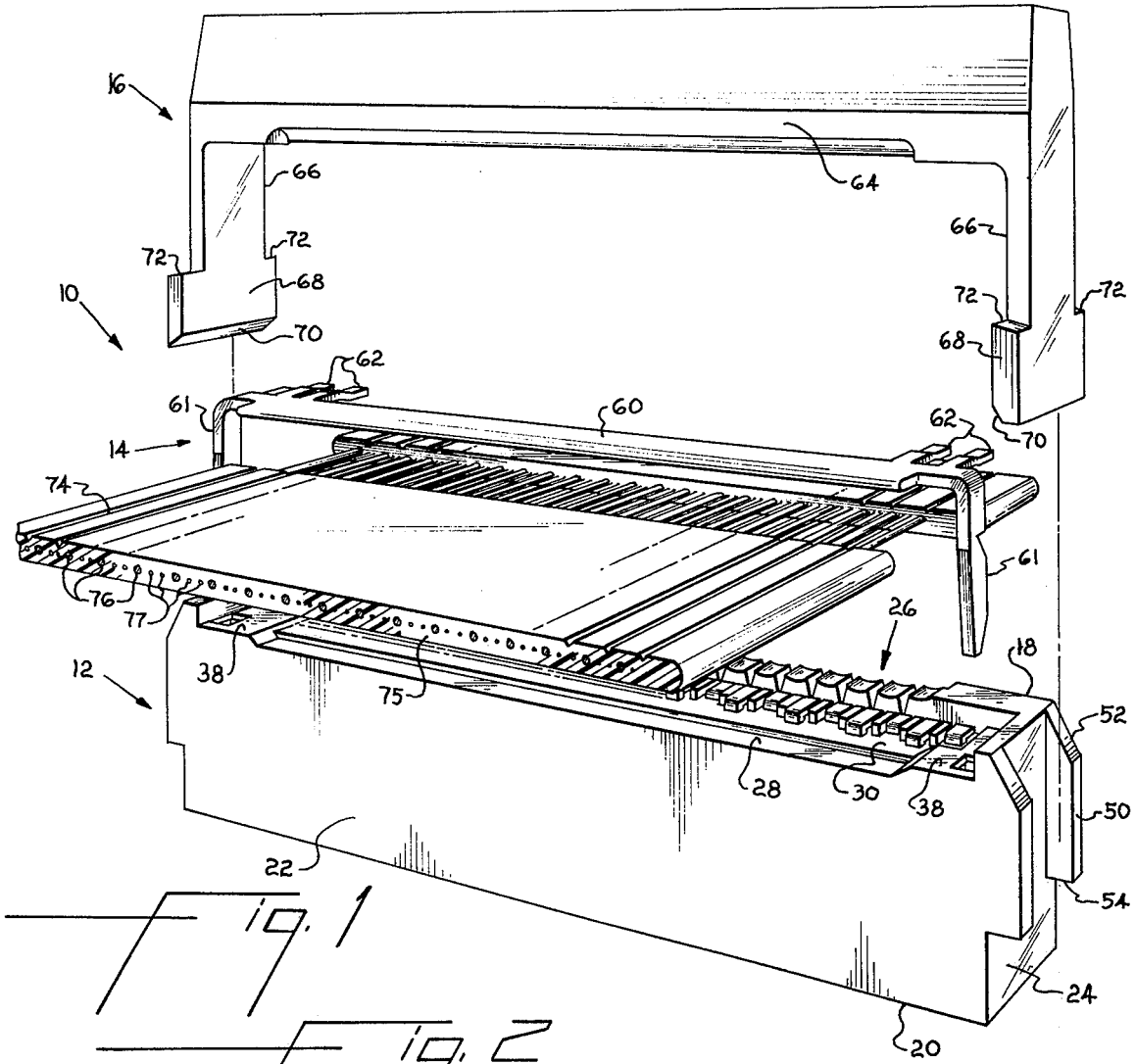
Fig. 1
Fig. 2
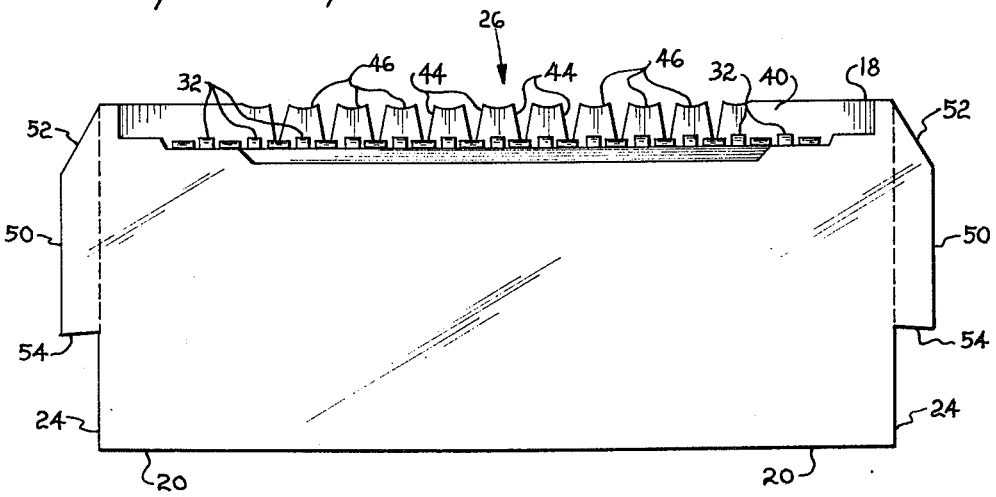

TRANSMISSION CABLE CONNECTOR AND TERMINATION METHOD

BACKGROUND OF THE INVENTION

1. Field of the Invention

The present invention relates to an electrical connector and method for mass terminating of multi-conductor transmission cable.

2. Description of the Prior Art

Electrical connectors for multi-conductor flat cables are well known in the electronic packaging arts. One such connector particularly adapted for use in jumper interconnecting of dual in-line sockets is described in U.S. Pat. No. 3,731,254. The connector described in this patent includes an insulating body having a plurality of terminals mounted therein for soldering to a corresponding plurality of conductors in a multi-conductor cable. However, in order to accommodate the increased speeds of electronic data processing equipment and reduce cross-talk between adjacent conductors in a multi-conductor cable, shielded multi-conductor cables having characteristic impedances have been developed. Electrical connectors for such cables are described in U.S. Pat. Nos. 3,634,806 and 3,907,396. In the connectors described in both of these patents, a multi-conductor cable including a plurality of signal conductors and an even number of drain or shield conductors having the insulation stripped from the ends thereof are separated and alternate signal and drain or shield conductors are terminated at opposite surfaces of a substrate. This type of connector requires fanning alternate conductors on opposite surfaces of a substrate and individual termination of each drain or shield conductor. Although this type of connector is generally suitable where the multi-conductor shielded cable includes an even number of signal and shield conductors, it is unsuitable for terminating more recently developed multi-conductor shielded cable including a pair of juxtaposed shield conductors on each side of each signal conductor. Additionally, the connectors, described in these patents require an individual terminal in the connector for each shield conductor greatly reducing the interconnection density for signal conductors in the connector.

The connector and method for terminating a multi-conductor transmission cable of the present invention provides a solution to the above problems by providing for mass termination of one or more shield conductors to a common bus strip and common termination of the bus strip. Additionally, termination of the signal conductors and shield conductors is accomplished on a common surface of the connector obviating the requirement for separating and fanning the alternate signal and shield conductors.

SUMMARY OF THE INVENTION

According to the present invention, an electrical connector and method of mass terminating a multi-conductor transmission cable including one or more shield conductors for each signal conductor is provided. The connector comprises an insulating body having a mating end and a conductor terminating end, a plurality of terminals mounted in the insulating body extending from the mating end to the conductor terminating end. The conductor terminating end of the body includes a face having a parapet extending therefrom, a plurality of V-shaped grooves in the parapet and a scalloped top on the parapet adjacent each groove. Signal conductors are received in the grooves and shield conductors are received by the scalloped surfaces. A terminal extending through the insulating body includes an L-shaped tail between spaced ribs on the face receiving each signal conductor in the multi-conductor cable. A metal bus strip is engageable with the face over the insulated segment of the transmission cable adjacent an edge of the insulating body and a cover is engageable with the face over the bus strip. The method includes severing an insulated sheath of the cable a distance from its end, sliding the severed insulated sheath along the conductors to expose a segment of the conductors, engaging the exposed signal conductors with a terminal on a face of a connector, severing the signal conductors, engaging the bus strip over the cable, folding the insulated end of the cable over the bus strip to engage the shield conductors with the bus strip, and soldering the signal conductors to the terminals and shield conductors to the bus strip.

BRIEF DESCRIPTION OF THE DRAWINGS

FIG. 1 is a perspective view of an embodiment of a connector according to the invention.

FIG. 2 is a front elevation view of an embodiment of a connector body according to the invention.

DESCRIPTION OF PREFERRED EMBODIMENTS OF THE INVENTION

Figure 3:
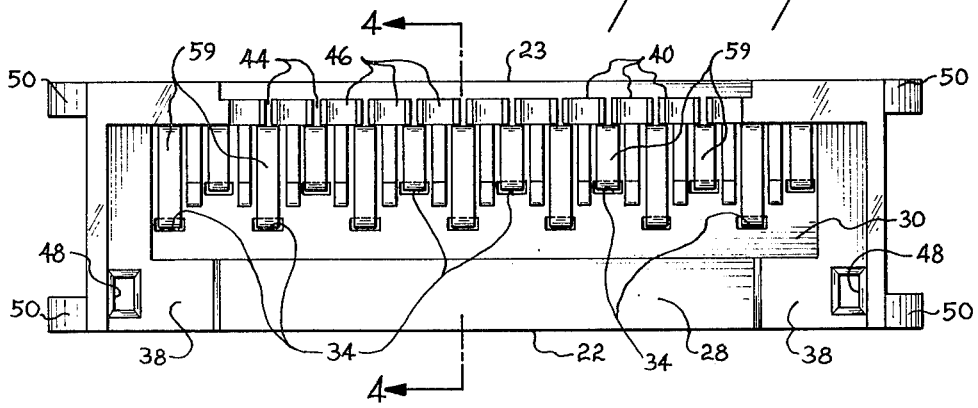
FIG. 3 is a plan view of a face of the connector body of FIG. 2.

Preferred embodiments of a connector and method of termination according to the present invention are described below with reference to the attached drawings wherein the same numerals are used throughout the various views to identify the same elements.

One embodiment of a connector 10 according to the invention is illustrated in FIGS. 1–6. The connector 10 comprises an insulating body 12, a grounding bus 14 engageable with the insulating body 12, and a cover 16 engageable with the body 12 to provide protection and strain relief for a transmission cable.

The insulating body 12 of the connector 10 is generally rectangular and includes a transmission cable terminating end 18, a mating end 20, laterally extending side walls 22, 23 and end walls 24. The transmission cable terminating end 18 of the body 12 comprises a face 26 having a laterally extending surface 28 for receiving an insulated segment of the cable, and a surface 30 including a plurality of spaced ribs 32. A pair of staggered rows of slots 34 are provided in face 30 and extend into the body 12. Face 26 also includes a surface 38 raised from surface 30 adjacent each end of body 12.

A parapet 40 extends from face 26 between each end wall 22 adjacent side wall 23. Parapet 40 is recessed from side wall 23 and includes a plurality of V-shaped grooves 44. Each groove 44 terminates on surface 30 between a pair of ribs 32. A scalloped top surface 46 is provided on parapet 40 adjacent each groove 44.

An opening 48 extending into the body 12 is provided in each surface 38 for receiving a leg of bus 14. A pair of latch receiving members 50 are provided on each end of body 12. Each member 50 includes a cam surface 52 and a latch surface 54. Two rows of terminal-receiving cavities 56 extend between the cable terminating end 18 and mating end 20 of insulating body 12. A female terminal 58 is mounted in each cavity. A tail 59 of each terminal 58 extends through each slot 34 and includes an L-shaped bend to position tail 59 on surface 30 between a pair of ribs 32.

The ground bus 14 comprises a laterally extending segment 60, a leg 61 at each end of segment 60 and a pair of fingers 62 adjacent each leg 61.

The cover 16 includes a central, laterally-extending section 64 and a latch arm 66 extending from each end of section 64. Each arm 66 includes a widened latch member 68 at the free end of arm 66. Each latch member 68 includes a cam surface 70 and a pair of latch surfaces 72.

Figure 4:
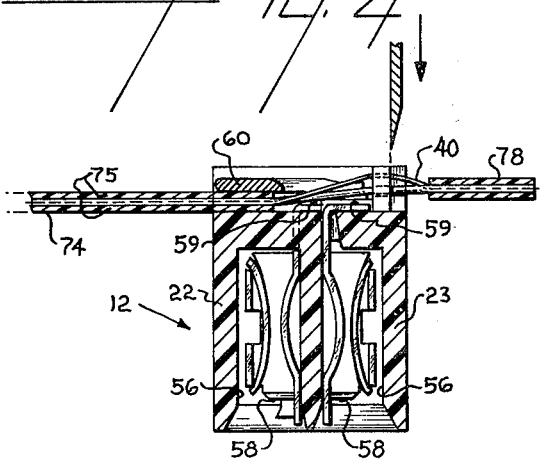
FIG. 4 is a side view in section taken along line 4—4 of FIG. 3.
Figure 5:
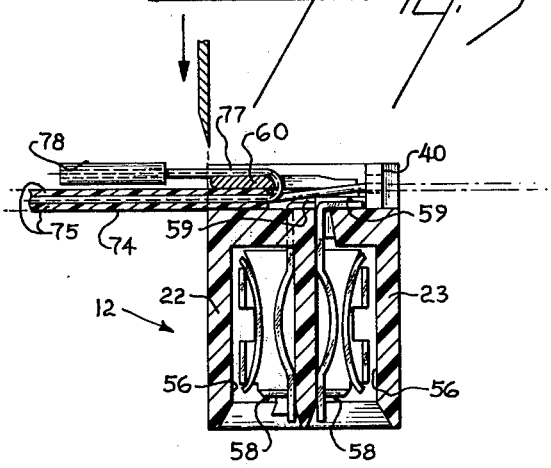
FIG. 5 is a side view similar to FIG. 4.
Figure 6:
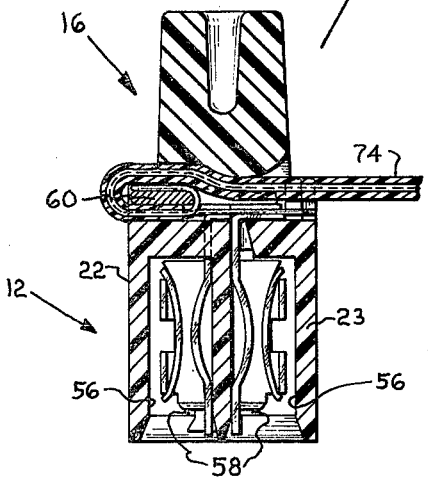
FIG. 6 is a side view similar to FIGS. 4 and 5 illustrating an assembled connector embodying the invention.
Figure 7:
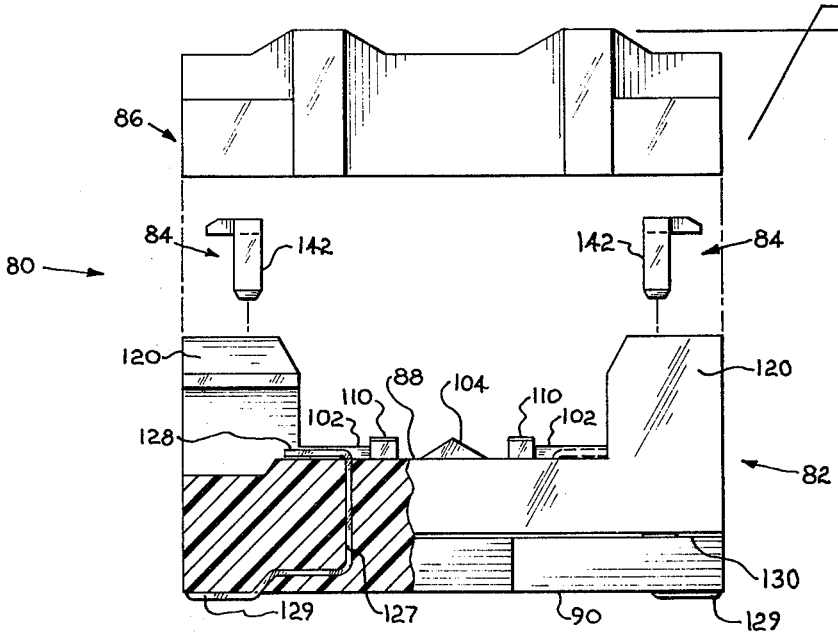
FIG. 7 is a side view in partial section along line 7—7 of FIG. 8 of an alternate embodiment of a connector according to the invention.
Figure 8:
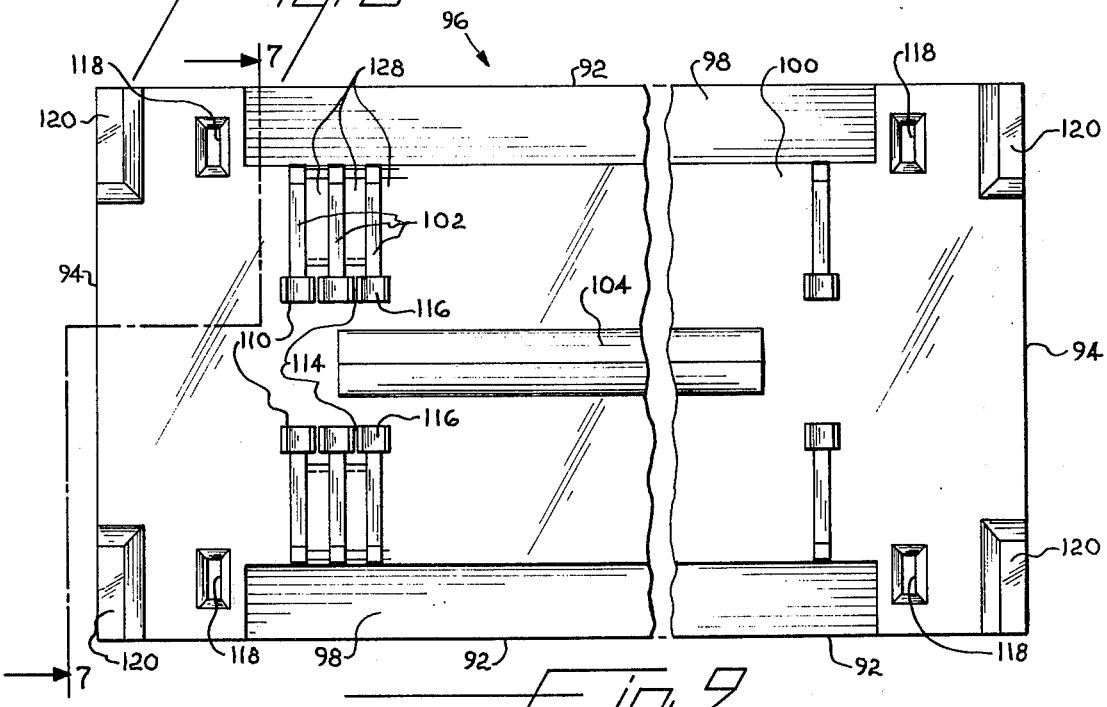
FIG. 8 is a plan view of a face of the connector body of FIG. 7.
Figure 9:
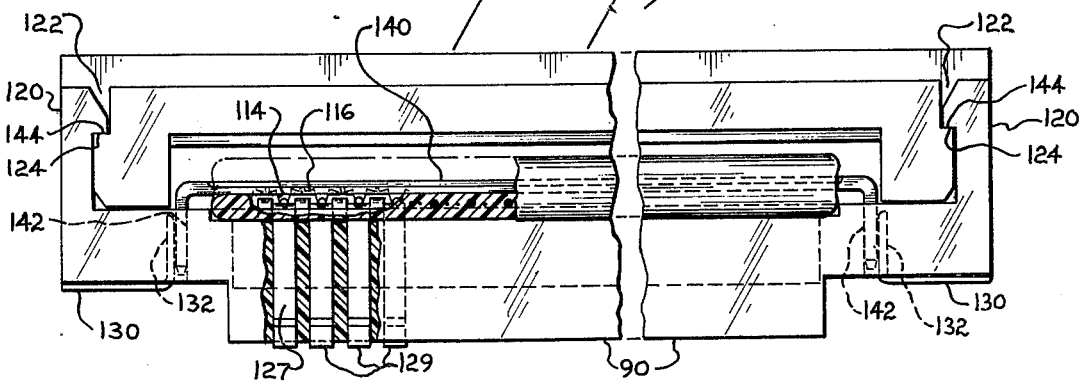
FIG. 9 is a front view of the embodiment of the connector of FIG. 7.

The method of terminating a transmission line according to the invention is described below with reference to the attached drawings, particularly FIGS. 1, 4, and 5.

A transmission cable 74 includes an insulating sheath 75 and a plurality of signal conductors 76 and shield conductors 77 encased in the sheath 75. An end 78 of the insulated sheath 75 is severed and slid forward along the conductors to expose a segment of the conductors intermediate the end of the transmission cable. The exposed segment of the conductors is engaged against the face 26 of insulating body 12 and the bus strip 14 is engaged with the face 26 with each leg 61 providing an interference fit in hole 48 at each surface 38 and segment 60 clamping the insulated sheath 75 against surface 28. Each signal conductor 76 is received in a groove 44 in parapet 40. Each shield conductor 77 is separated from the signal conductor 76 by the scalloped surface 46 adjacent each V-shaped groove. A knife selectively severs each signal conductor 76 and stuffs the conductor 76 in each groove 44 adjacent surface 30 of face 26 of body 12. Each signal conductor 76 is held in each groove 44 in contact with a terminal tail 59 between spaced ribs 32. The insulated end of the transmission cable is folded back along itself, and the shield conductors 77 are engaged with section 60 of ground bus 14. The folded end of the cable sheath is secured along itself, e.g. by taping. The transmission line is terminated by heating the terminal tails and ground bus to flow a layer of solder thereon, e.g. by infra-red heating lamps, and then cooled to establish a soldered connection between each signal conductor 76 and terminal tail 59, each shield conductor 77 and the ground bus 14, and each finger 62 of the ground bus with a terminal tail 59. The ground conductors are then severed adjacent the stripped insulated end of the transmission cable. The insulated transmission cable away from the terminated ends is then folded back over the face 26 of the terminating end and the cover 16 engaged with the base to protect the termination and provide a strain relief for the terminated transmission cable.

Each signal conductor 76 in the cable 74 is permanently electrically and mechanically connected by a soldered connection to a female terminal 58 mounted in the insulating body 12. Each shield conductor 77 is permanently electrically and mechanically connected by a soldered connection to the bus strip 14. The bus strip is permanently electrically and mechanically connected to one or more female terminals 58 by a soldered connection between each finger 62 of the bus strip 14 and a tail 59 of a female terminal 58 mounted in the insulating body 12.

In another embodiment, a connector 80 according to the invention comprises an insulating base 82, a pair of grounding buses 84 and a cover 86.

The insulating base 82 of the connector 80 is generally rectangular and includes a transmission cable terminating end 88, a mating end 90, laterally extending side walls 92, and end walls 94. The transmission cable terminating end 88 comprises a face 96 having a laterally extending surface 98 adjacent each side wall 92, and a central surface 100 including a pair of rows of spaced ribs 102. A row of slots 104 is provided in surface 100 between each pair of ribs 102.

A parapet 110 is provided adjacent the interior ends of each row of ribs 102. Each parapet 110 includes a plurality of V-shaped grooves 114. Each groove 114 terminates on surface 100 between a pair of ribs 102. A scalloped surface 116 is provided along the top of each parapet adjacent each groove 114.

An opening 118 extends into the base 82 in surface 100 adjacent each end of recessed surface 98 for receiving a leg of the ground bus 84. Latch members 120 are provided at each corner of the base 80. Each member 120 includes a cam surface 122 and a latch surface 124. A terminal 128 is mounted in each slot 114 and includes an L-shaped tail between a pair of ribs 102, and a contact adjacent each side wall 92 on the mating end 90 of base 82.

A grounding pad 130 is provided on the mating end 90 of base 82 and includes a leg 132 extending into each opening 118 in base 82. Each bus strip 84 comprises a laterally extending segment 140 and a leg 142 at each end of the segment 140. Each leg 142 is engageable in hole 118 providing an interference fit.

The cover 86 is generally rectangular and includes a latch surface 142 at each corner for engagement by each latch member 120 at each corner of the base 82.

A pair of flat, multi-conductor transmission cables may be terminated on the face 96 of the base 82 according to the method of the invention described above with reference to the embodiment of the connector illustrated in FIGS. 1–6. In the latter embodiment, each signal and shield conductor of the cable is terminated as in the former embodiment, e.g. by reflow soldering, and the bus strip is permanently electrically and mechanically connected to the grounding pads 130 by a soldered connection between each leg 132 of the ground pad 130 and each leg 142 of the bus strip 84.

In each embodiment 10, 82 of the connector, the terminals and bus strip are formed of a suitable metal, e.g. curpro-nickel, brass or copper and plated with gold or tin/lead to provide improved conductivity and or corrosion resistance. Preferably, each terminal tail and bus strip is provided with an adherent layer of solder of sufficient thickness to provide the required permanent electrical and mechanical connections when the solder layer is heated and reflowed. Alternatively, such connections may be provided for example by wave or dip soldering.

The former embodiment of the connector is particularly useful for interconnecting a cable to a circuit board having a plurality of circuit board pins mounted in holes therein in a pattern corresponding to the terminals in the insulating body. The latter embodiment is particularly useful for providing jumper interconnection on one or more circuit boards between connector blocks for leadless integrated circuit packages.

What is claimed is:

1. An electrical connector for a flat, insulated, multi-conductor transmission cable having a plurality of signal conductors and one or more shield conductors for each signal conductor comprising an insulating body having a cable terminating end and a mating end, a plurality of terminals mounted in said body extending from said cable terminating end to said mating end, and a bus strip engageable with said cable terminating end; said conductor terminating end of said body having a face including a central ribbed section for receiving a tail of each terminal, and means on said face adjacent said central ribbed section for receiving a plurality of signal conductors in the transmission cable and for separating the shield conductors in the cable from the signal conductors.

2. A connector, as recited in claim 1, wherein said means on said face comprises a parapet including a V-shaped groove for receiving each signal conductor and a scalloped top for separating the shield conductors.

3. A connector, as recited in claim 1, said bus strip including at least one finger engageable with a tail of a terminal mounted in said body.

4. A connector, as recited in claim 1, additionally comprising a grounding pad on said mating end of the insulating body and said bus strip being engageable with said grounding pad.

5. A connector, as recited in claim 1, wherein each V-shaped groove terminates on said face of said insulating body between a pair of spaced ribs.

6. A connector, as recited in claim 1, additionally comprising a cover engageable with said insulating body.

7. An electrical connector assembly comprising a flat, insulated, multi-conductor transmission cable having a plurality of signal conductors and one or more shield conductors for each signal conductor, an insulating body having a cable terminating end and a mating end, a plurality of terminals mounted in said body extending from said cable terminating end to said mating end, a bus strip engaged with said cable terminating end over an insulated end of said cable, and a cover engaged with said insulating body; said conductor terminating end of said body having a face including a central ribbed section and a tail of each terminal extending between adjacent ribs, a parapet extending from said face adjacent said central ribbed section, said parapet including a plurality of V-shaped grooves, each V-shaped groove having a signal conductor positioned therein and a scalloped top for separating the shield conductors from the signal conductors, each signal conductor bent back along the cable in engagement with the bus strip and soldered to said bus strip, and each signal conductor soldered to a terminal tail along said face of said insulating body.

8. A connector, as recited in claim 7, said bus strip including at least one finger soldered to a tail of a terminal mounted in said body.

9. A connector, as recited in claim 7, additionally comprising a grounding pad on the mating end of the insulating body and said bus strip being connected with said grounding pad.

10. A connector, as recited in claim 7, additionally comprising a cover engaged with said insulating body over said terminals and said bus strip.

11. A method of terminating a flat, insulated, multi-conductor transmission cable including a plurality of signal conductors and one or more shield conductors for each signal conductor comprising severing an insulated sheath of said cable a distance from its end, sliding the severed insulated end of the sheath along the conductors in the cable to expose a segment of the conductors, engaging each exposed signal conductor with a terminal along a face of an insulating body, engaging a bus strip over an insulated segment of the cable intermediate its end, severing each signal conductor of said cable, folding the insulated end of the cable back along the cable, and engaging each shield conductor with the bus strip.

12. A method, as recited in claim 11, additionally comprising soldering each signal conductor to a terminal along said face of said insulating body and each shield conductor to said bus strip.

13. A method, as recited in claim 11, wherein said soldering comprises heating a layer of solder adherent to each terminal and said bus strip to reflow the layer of solder.

* * * * *

UNITED STATES PATENT OFFICE

CERTIFICATE OF CORRECTION

PATENT NO. : 4,005,921

DATED : February 1, 1977

INVENTOR(S) : Edward Leal Hadden and Robert Franklin Evans

It is certified that error appears in the above-identified patent and that said Letters Patent are hereby corrected as shown below:

Claim 1, line 9, change "conductor" to --cable--.

Claim 5, line 1, change "1" to --2--.

Claim 7, line 10, change "conductor" to --cable--; and line 8, change "signal" second occurrence to -- shield --.

Signed and Sealed this

Seventh Day of June 1977

[SEAL]

*Attest:*

RUTH C. MASON
*Attesting Officer*

C. MARSHALL DANN
*Commissioner of Patents and Trademarks*